United States Patent [19]

Weitz

[11] Patent Number: 4,816,301

[45] Date of Patent: Mar. 28, 1989

[54] ARTIFICIAL PLANT ASSEMBLED FROM LOCKED TOGETHER PLANT ORGAN SIMULATING MEMBERS

[75] Inventor: Henry Weitz, Kowloon, Hong Kong

[73] Assignee: Magicsilk, Inc., Rutherford, N.J.

[21] Appl. No.: 152,431

[22] Filed: Feb. 5, 1988

[51] Int. Cl.[4] ..... A41G 1/00

[52] U.S. Cl. ..... 428/17; 428/26; 428/100

[58] Field of Search ..... 428/17, 24, 26, 100

[56] References Cited

U.S. PATENT DOCUMENTS

| | | | |
|---|---|---|---|
| 3,137,610 | 6/1964 | Flynn | 428/26 |
| 3,711,696 | 1/1973 | Sieloff | 428/24 X |
| 4,369,216 | 1/1983 | Willinger | 428/23 X |
| 4,423,098 | 12/1983 | Weitz | 428/24 X |
| 4,585,677 | 4/1986 | Hwang et al. | 428/26 |

*Primary Examiner*—Henry F. Epstein
*Attorney, Agent, or Firm*—Alvin Sinderbrand

[57] ABSTRACT

In an artificial representation of a plant formed of plant organ simulating members, such as, stem and leaf simulating members, respectively having rod-like and tubular connecting portions molded of synthetic resin and being axially interengaged to provide a joint for asembling together the respective plant organ simulating members; each tubular connecting portion has an axial bore with an opening at least at one end of the axial insertion of the respective rod-like connecting portion therein and a seating surface extending outwardly from the bore and facing away from the open one end of the latter at a location spaced axially from that one end; and each rod-like connecting portion has a free end with a barb extending therefrom which is flexed inwardly from an original configuration upon the axial insertion of the respective rod-like connecting portion into the bore and which returns to its original configuration upon attaining the location of the seating surface for engaging the latter and thereby locking together the interengaged plant organ simulating members.

7 Claims, 2 Drawing Sheets

FIG. 5
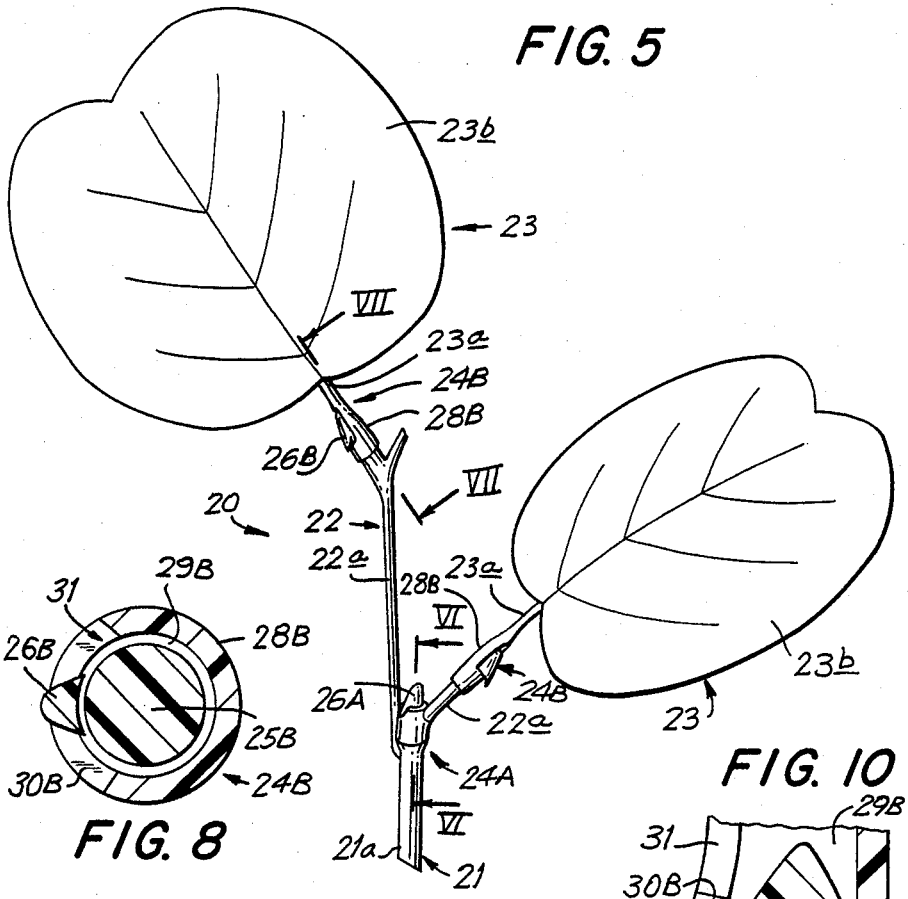
FIG. 8
FIG. 10
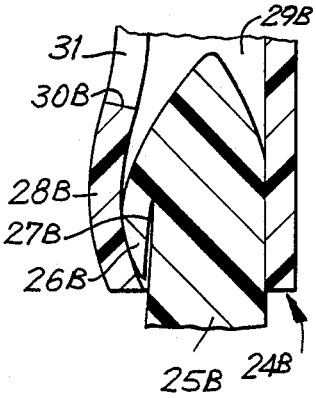
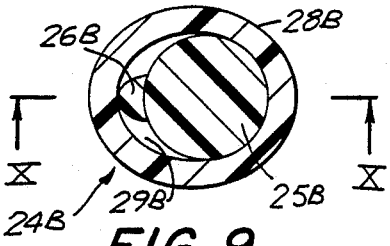
FIG. 9
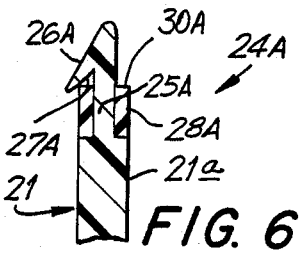
FIG. 6
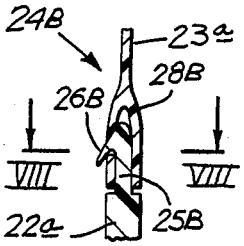
FIG. 7

ARTIFICIAL PLANT ASSEMBLED FROM LOCKED TOGETHER PLANT ORGAN SIMULATING MEMBERS

BACKGROUND OF THE INVENTION

1. Field of the Invention

This invention relates generally to artificial plants and, more particularly, is directed to improvements in artificial representations or simulations of plants of the type comprised of stem-simulating members molded of plastic and terminating in numerous stem portions on which separately molded or formed flower or leaf-simulating members are mounted.

2. Description of the Prior Art

It is known to provide an artificial plant by assembling together numerous plant organ simulating members, such as, stem-simulating members molded of plastic and having suitably configured, branching stem portions, and flower or leaf-simulating members which are separately formed and connected, at respective joints, to the branching stem portions. In known artificial plants of the described character, at each joint where plant organ simulating members are to be connected to each other, one of such members is provided with a projecting rod-like connecting portion having a bulbous free end, and the other of the respective members is provided with a tubular or ring-like connecting portion dimensioned so that the bulbous free end of the rod-like connecting portion is slightly larger than the central hole or opening of the tubular or ring-like portion. Thus, when assembling together the plant organ simulating members, the bulbous free end of each rod-like connecting portion is forced through the central opening or hole of the respective tubular or ring-like connecting portion which is circumferentially distended until the bulbous free end of the rod-like connecting portion exits from the hole of the ring-like connecting portion which then returns to its original configuration on the respective rod-like connecting portion. Thereafter, separation of the rod-like and ring-like connecting portions is resisted by the fact that the bulbous free end of the rod-like connecting portion is larger than the hole of the ring-like connecting portion. The extent to which such separation is resisted obviously depends upon the relative diametrical dimensions of the bulbous free end of the rod-like connecting portion and of the hole in the ring-like connecting portion. However, if the bulbous free end is made large enough relative to the size of the hole in the respective ring-like connecting portion so as to strongly resist separation of the respective plant organ simulating members, the assembling together of such members is rendered difficult by the need to substantially circumferentially distend the ring-like connecting portion during the assembly and, further, such substantial circumferential distending of the ring-like connecting portion often causes splitting or cracking of the latter with the result that the respective plant organ simulating member is no longer secured to the remainder of the assemblage.

In other known artificial plants of the described character, each flower or leaf-simulating member has a petiole-like part molded of plastic and terminating in a socket or tubular connecting portion which is open only at one end for axially receiving a respective rod-like connecting portion extending from a stem-simulating member. If the socket or tubular connecting portion is merely dimensioned to be frictionally retained on the respective rod-like connecting portion, the resulting joint is liable to be separated or disconnected when the respective flower or leaf-simulating member is tugged or pulled. On the other hand, if the rod-like connecting portion is provided with a ridge extending there-around or with a bulbous section, and the respective socket or tubular connecting portion is formed with a corresponding annular groove or enlargement in its inner surface so that the annular ridge or bulbous

39-241.027 section will snap into such groove or enlargement after circumferential distending of the socket upon the axial insertion of the rod-like connecting portion into the socket or tubular connecting portion, there is again the danger that the socket or tubular connecting portion will be overstressed circumferentially and split axially during the assembling together of the plant organ simulating members.

OBJECTS AND SUMMARY OF THE INVENTION

Accordingly, it is an object of this invention to provide an artificial representation of a plant which can be easily assembled from various separately formed plant organ simulating members, and which avoids the above described disadvantages of the prior art.

More specifically, it is an object of this invention to provide an artificial representation of a plant by assembling together plant organ simulating members which are economically and reliably secured or locked against separation from each other.

Another object of this invention is to provide an artificial representation of a plant, as aforesaid, in which the plant organ simulating members respectively have rod-like and tubular connecting portions which are axially interengaged to provide a joint for assembling together the respective plant organ simulating members, and in which the interengaged rod-like and tubular connecting portions are mechanically locked or secured against separation from each other in a manner that avoids splitting or cracking of the tubular connecting portions.

In accordance with an aspect of this invention, in an artificial representation of a plant comprising plant organ simulating members respectively having rod-like and tubular connecting portions molded of synthetic resin and being axially interengaged to provide a joint for assembling together the respective plant organ simulating members; each tubular connecting portion has an axial bore with an opening at least at one end for the axial insertion of the respective rod-like connecting portion therein and a seating surface extending outwardly from the bore and facing axially away from that one end at a location spaced axially therefrom, and the rod-like connecting portion has a free end with a barb extending therefrom which is flexed inwardly from an original configuration upon the axial insertion of the respective rod-like connecting portion into the bore and which returns to its original configuration upon attaining the location for engaging the seating surface and thereby locking together the interengaged plant organ simulating members.

In accordance with another aspect of the invention the rod-like tubular connecting portions originally have substantially circular cross sections, each tubular connecting portion is flexed out-of-of round from its original substantially circular cross section upon insertion of the free end of the respective rod-like connecting portion with the barb thereon into the bore, and the tubular connecting portion returns to its original substantially circular cross section when the barb engages the seating surface.

In accordance with one embodiment of this invention, the bore in each tubular connecting portion opens axially at both ends, and the seating surface extends angularly around the end of the bore which is remote from the end into which the rod-like connecting portion is inserted.

In accordance with another embodiment of the invention, the bore of each tubular connecting portion is closed axially at the end thereof remote from the end having the opening for insertion of the respective rod-like connecting portion, the tubular connecting portion has a hole opening laterally from the bore with the seating surface being constituted by an edge of such hole, and the barb at the free end of the rod-like connecting portion is adapted to project into the laterally opening hole for engaging the seating surface.

The above, and other objects, features and advantages of this invention, will be apparent in the following detailed description of illustrative embodiments thereof which is to be read in connection with the accompanying drawings in which corresponding parts are identified by the same reference numerals in the several views.

BRIEF DESCRIPTION OF THE DRAWINGS

FIG. 5 is a perspective view showing the plant organ simulating members of FIG. 3 assembled together to form an artificial representation of a plant;

FIGS. 6 and 7 are fragmentary, enlarged sectional views taken along the lines VI—VI and VII—VII, respectively, and illustrating joints according to different embodiments of the present invention;

FIG. 8 is a further enlarged sectional view taken along the line VIII—VIII on FIG. 7;

FIG. 9 is a sectional view similar to that of FIG. 8, but showing the configurations of a rod-like connecting portion and a tubular connecting portion according to an embodiment of this invention during the interengagement thereof; and FIG. 10 is a sectional view taken along the line X—X on FIG. 9.

DESCRIPTION OF THE PREFERRED EMBODIMENTS

Figure 1:
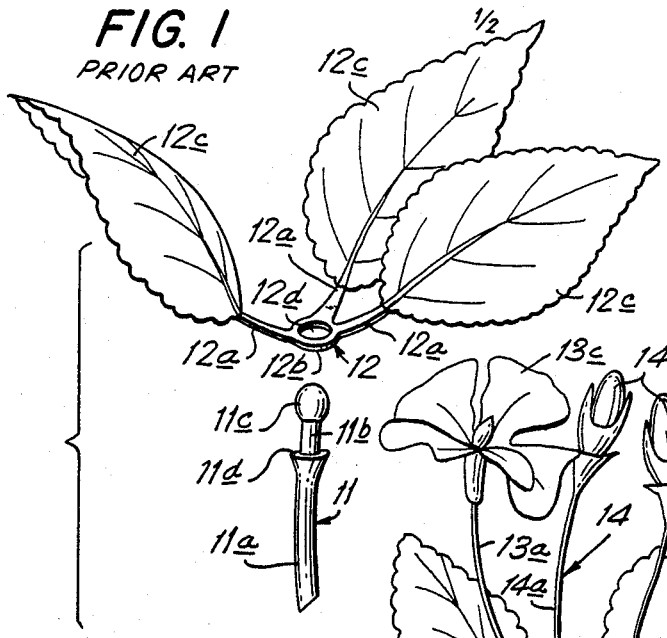
FIG. 1 PRIOR ART
FIG. 1 is an exploded perspective view showing plant organ simulating members according to the prior art that may be assembled together for forming an artificial representation of a plant.

Initially, reference will be made to FIGS. 1 and 2 which illustrate an artificial plant 10 according to the prior art, and in which plant organ simulating members 11, 12, 13 and 14 are separately formed, preferably at least in part by molding of a synthetic resin, and then suitably assembled together at a joint 15. In the illustrated artificial plant 10, the plant organ simulating member 11 constitutes a stem-simulating member suitably configured in its molding so as to define a main stem portion **11*a* having a rod-like connecting portion 11*b* extending from its upper end and terminating in a bulbous free end 11*c*. A shoulder 11*d* is suitably formed between the stem portion 11*a* and the rod-like connecting portion 11*b***.

The illustrated plant organ simulating member 12 is a leaf-simulating member including stalks or petiole-like parts **12*a* radiating from a ring-like connecting portion 12*b* and having leaf-like parts 12*c* carried by the petiole-like parts 12*a* and being desirably formed of a suitable fabric coated with the synthetic resin. The ring-like connecting portion 12*b* is dimensioned so that the bulbous free end 11*c* of the rod-line connecting portion 11*b* is slightly larger than the central hole or opening 12*d* of the ring-like connecting portion 12*b*. When assembling together the plant organ simulating members 11 and 12, the bulbous free end 11*c* of the rod-like connecting portion 11*b* is forced through the central opening or hole 12*d* of the ring-like connecting portion 12*b* which is thereby circumferentially distended until the bulbous free end 11*c* exits from the hole 12*d* and the ring-like connecting portion 12*b* then returns to its original configuration around the rod-like connecting portion 11*b* and rests on the shoulder 11*d***.

The remaining plant organ simulating members 13 and 14 constitute a flower-simulating member and a bud simulating member, respectively, which are, in their important respect, similar to the plant organ simulating member 12. Thus, the plant organ simulating member 13 includes petiole-like parts **13*a* radiating upwardly from a ring-like connecting portion 13*b* and terminating in flower-like parts 13*c*. Similarly, the plant organ simulating member 14 is shown to include petiole-like parts 14*a* radiating upwardly from a ring-like connecting portion 14*b* and terminating in bud-like parts 14*c*. The ring-like connecting portions 13*b* and 14*b* are dimensioned similarly to the ring-like connecting portion 12*b* and are forced successively over the bulbous free end 11*c* onto the rod-like connecting portion 11*b* above the ring-like connecting portion 12*b*, as shown on FIG. 2. It will be appreciated that the ring-like connecting portions 13*b* and 14*b* are also circumferentially distended in passing over the bulbous free end 11*c* and return to their original configurations on the rod-like connecting portion 11*b***.

Figure 2:
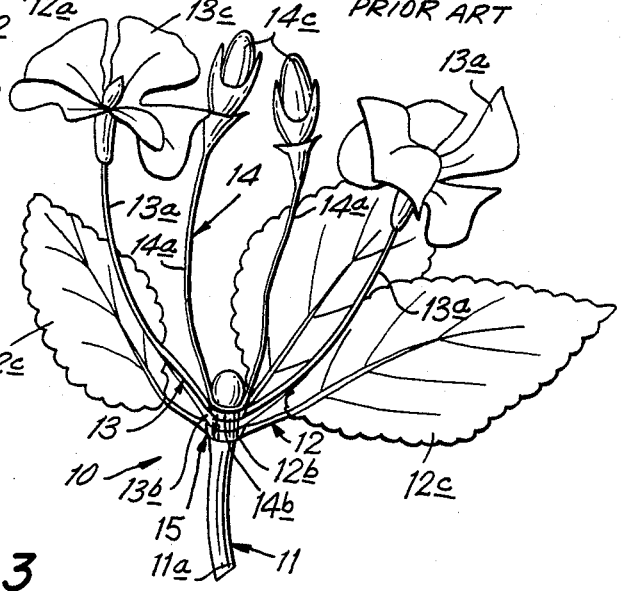
FIG. 2 PRIOR ART
FIG. 2 is a perspective view showing an artificial representation of a plant according to the prior art formed by assembling together various plant organ simulating members including those shown on FIG. 1.

After assembling together of the plant organ simulating members 11, 12, 13 and 14, as shown on FIG. 2, separation of the ring-like connecting portions **12*b*, 13*b* and 14*b* from the rod-like connecting portion 11*b* is resisted by the fact that the bulbous free end 11*c* of the rod-like connecting portion 11*b* is larger than the hole of each of the ring-like connecting portions. The resistance to separation obviously depends upon the relative diametrical dimensions of the bulbous free end 11*c* of the rod-like connecting portion and of the holes in the ring-like connecting portions 12*b*, 13*b* and 14*b*. However, if the bulbous free end 11*c* is made large enough relative to the size of the hole in each of the ring-like connecting portions 12*b*, 13*b* and 14*b* so as to strongly resist separation of the respective plant organ simulating members, the assembling together of such members is made difficult by the need to substantially circumferentially distend or stretch each of the ring-like connecting portions during the assembly. Further, the substantial circumferential distending of the ring-like connecting portion, which results at least in part from the fact that the enlarged or bulbous free end 11***c* is larger, in all diametrical dimensions, than the hole in each of the ring-like connecting portions 12*b*, 13*b* and 14*b*, often causes splitting or cracking of the latter with the result that the respective plant organ simulating member is no longer secured to the remainder of the artificial plant 10.

Figure 3:
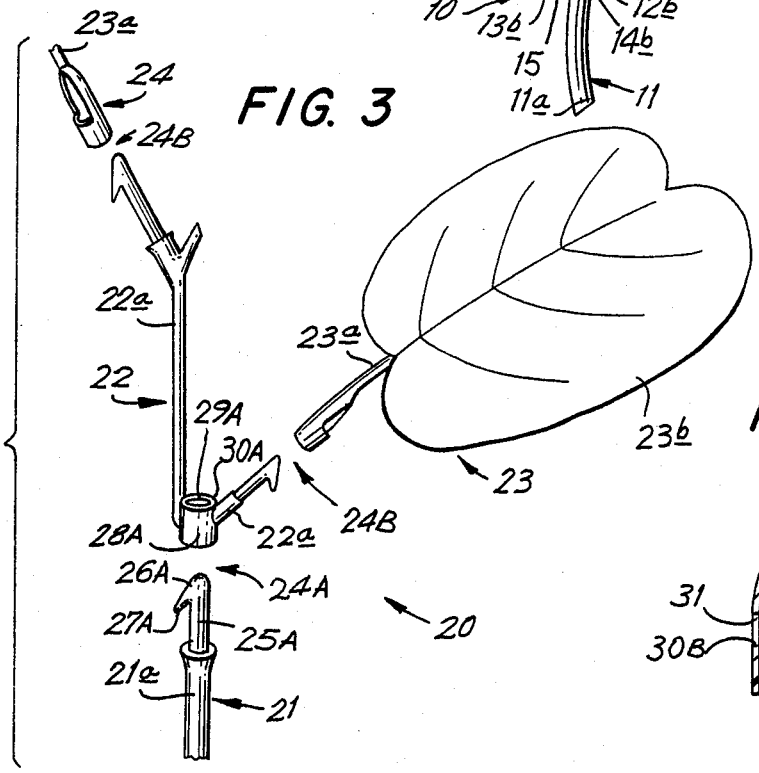
FIG. 3 is an exploded perspective view showing various plant organ simulating members having connecting portions according to embodiments of this invention that are interengageable for assembling together the respective plant organ simulating members.

Referring now to FIGS. 3 and 5, it will be seen that an artificial plant 20 according to an embodiment of the present invention, and which avoids the above described disadvantages and problems in connection with the prior art, similarly generally comprises plant organ simulating members 21, 22 and 23 which are separately formed, preferably at least in part by molding of a synthetic resin, and then assembled together at joints 24A or 24B. More specifically, in the illustrated artificial plant 20, the plant organ simulating member 21 is molded to define a main stem portion 21*a*, and the plant organ simulating member 22 is molded to define branching stem portions 22*a* which, in the assembled condition of the artificial plant 20, will appear to be branching from the main stem portion 21*a*. Further, in the illustrated artificial plant 20, each of the plant organ simulating members 23 is a leaf-simulating member including a stalk or petiole-like part 23*a* molded of synthetic resin and having one or more leaf-like parts 23*b* branching therefrom and desirably formed of a suitable fabric which may be coated with the resin.

Each joint 24A for assembling together two of the plant organ simulating members, for example, the member 21 simulating a main stem and the member 22 simulating branching stems, includes a respective rod-like connecting portion 25A extending from an end of the main stem portion 21*a* and having a free end with a substantially triangular barb 26A extending laterally therefrom. It will be apparent from FIGS. 3 and 6 that the barb 26A is raked back from the free end of the rod-like connecting portion 25A so that its lower end edge 27A, as viewed on the drawings, is undercut.

The joint, 24A is further shown to include a respective tubular connecting portion 28A having the branching stem portions 22*a* extending from its outer periphery, and being formed with an axial bore 29A which, in the case of the embodiment of the invention typified by the joint 24A, opens axially at both ends of the tubular connecting portion 28A. Further, the annular upper end surface of the tubular connecting portion 28A defines a seating surface 30A which extends outwardly from the bore 29A and which faces axially away from, and is also spaced from the lower open end of the bore 29A into which the rod-like connecting portion 25A is inserted when axially interengaging the connecting portions 25A and 28A as hereinafter described.

When interengaging the rod-like and tubular connecting portions 25A and 28A to form the joint 24A, the free end of the rod-like connecting portion 25A is inserted axially into the lower open end of the bore 29B and thrust upwardly through the tubular connecting portion 28A. The bore 29A is diametrically dimensioned so that the raked or undercut barb 26A can pass upwardly through the bore 29A only as a consequence of the flexing of the barb 26A inwardly against the adjacent surface of the rod-like connecting portion 25A from its normally outwardly projecting configuration, and further as a consequence of the flexing of the tubular connecting portion 28A out of round from its original substantially circular cross section, as will be hereinafter further described in detail. When the barb 26A emerges from the open upper end of the bore 29A, the barb 26A is free to return elastically to its original outwardly projecting configuration and the tubular connecting portion 28A is similarly free to elastically return to its original circular cross section so that the barb 26A then extends across and securely engages against the seating surface 30A for positively preventing removal of the rod-like connecting portion 25A from the tubular connecting portion 28A and thereby locking together the interengaged plant organ simulating members 21 and 22.

Figure 4:
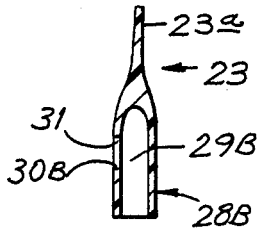
FIG. 4 is an enlarged, fragmentary sectional view showing a tubular connecting portion in accordance with one embodiment of the present invention.

Each of the joints 24B is shown to include a rod-like connecting portion 25B projecting from a respective one of the branching stem portions 22*a* and being, in all respects, similar to the previously described rod-like connecting portion 25A so as to have a barb 26B raked back from the free end of the rod-like connecting portion 25B. Each joint 24B also includes a tubular connecting portion 28B which is molded integrally, at one end, with the petiole-like part 23*a* of the respective leaf-simulating member 23. In the case of the embodiment of the invention typified by the joint 24B, the axial bore 29B of the tubular connecting portion 28B opens axially only at the end remote from the connection to the petiole-like part 23*a* and, in such case, the seating surface 30B spaced from, and facing away from the open end of the bore 29B is defined by an edge of a hole 31 opening laterally from the bore 29B (FIGS. 4 and 10).

As shown particularly on FIG. 8, the rod-like and tubular connecting portions 25B and 28B normally have circular cross sectional configurations, with the diameter of the bore 29B being only slightly larger than the diameter of the rod-like connecting portion 25B so that the barb 26B, in its normal outwardly extending configuration, projects well beyond the inner wall surface of the tubular connecting portion 28B. When interengaging the rod-like and tubular connecting portions 25B and 28B, the free end of the rod-like connecting portion 25B is thrust axially into the open end of the bore 29B and, in response thereto, the outwardly projecting barb 26B is flexed inwardly against the adjacent surface of rod-like connecting portion 25B and the normally circular tubular connecting portion 28B is flexed out-of-round, as shown particularly on FIGS. 9 and 10 so as to permit the axial movement of the rod-like connecting portion with its barb 26B along the bore 29B without requiring substantial circumferential distending of the tubular connecting portion 28B. Of course, when the rod-like connecting portion 25B attains a position along bore 29B in which the barb 26B can extend through lateral opening 31, the barb 26B elastically returns to its original configuration and engages the seating surface 30B defined by the lower edge portion of hole 31, as shown particularly on FIGS. 7 and 8. Thus, once again, the engagement of the barb 26B with the seating surface 30B locks together the interengaged connecting portions 25B and 28B so that the plant organ simulating members 22 and 23 can not be separated from each other at the joints 24B.

It will be appreciated that, in the described embodiments of this invention typified by the joints 24A and 24B, there is substantial radial interference between the barb 26A and seat 30A and between the barb 26B and seating surface 30B when the joints 24A and 24B are completely engaged, thereby to provide reliable locking of the joints. Furthermore, such substantial radial interference for secured locking is achieved without requiring substantial circumferential distending of the tubular connecting portions 28A and 28B during axial insertion of the rod-like connecting portion 25A or 25B into the tubular connecting portion 28A or 28B, respectively. In each instance, during insertion, the described substantial radial interference is overcome by the combination of the flexing of the raked barb 26A or 26B and the out-of-round flexing of the tubular connecting portion 28A or 28B, so that substantial circumferential distending of the tubular connecting portion is not necessary for avoiding splitting of the latter.

In FIGS. 3 and 5, the invention is shown applied to an artificial plant 20 comprised of only the stem-simulating members 21 and 22 and the leaf-simulating members 23. However, it will be appreciated that the joints 24A and 24B embodying the invention can also be similarly applied to the assembling of flower-simulating members or bud-simulating members, for example, as indicated at 13 and 14 on FIG. 2.

Although preferred embodiments of the invention have been specifically described with reference to the accompanying drawings, it is to be understood that the invention is not limited to those precise embodiments thereof, and that various changes and modifications may be effected therein by one skilled in the art without departing from the scope or spirit of the invention as defined in the appended claims.

What is claimed is:

1. In an artificial representation of a plant comprising plant organ simulating members respectively having rod-like and tubular connecting portions molded of synthetic resin and being axially interengaged to provide a joint for assembling together the respective plant organ simulating members; said tubular connecting portion having an axial bore with an opening at least at one end for the axial insertion of said rod-like connecting portion therein and a seating surface extending outwardly from said bore at a location spaced axially from said one end and facing axially away from said opening at said one end; and said rod-like connecting portion having a free end with a barb extending therefrom which is raked back from said free end, said barb being flexed inwardly from an original configuration upon said axial insertion of the respective rod-like connecting portion into said bore and returning to said original configuration upon attaining said location for engaging said seating surface and thereby locking together the interengaged plant organ simulating members.

2. An artificial representation of a plant according to claim 1; in which said rod-like and tubular connecting portions originally have substantially circular cross-sections, and said tubular connecting portion is also flexed out-of-round from said original substantially circular cross-section upon insertion of said free end of the rod-like connecting portion with said barb thereon into said bore and returns to said original substantially circular cross-section when said barb engages said seating surface.

3. An artificial representation of a plant according to claim 1; in which said bore also opens axially at the other end thereof, and said seating surface extends annularly around said other end of the bore; and in which, when said rod-like and tubular connecting portions are interengaged, said free end of the rod-like connecting portion projects from said other open end of the bore for engaging said barb with said annularly extending seating surface.

4. An artificial representation of a plant according to claim 3; in which said plant organ simulating member having said rod-like connecting portion includes a main stem portion terminating in said rod-like connecting portion, and said plant organ simulating member having said tubular connecting portion includes branching stem portions extending from the periphery of said tubular connecting portion.

5. An artificial representation of a plant according to claim 1; in which said bore of the tubular connecting portion is closed axially at the other end thereof, said tubular connecting portion has a hole opening laterally from said bore, said seating surface is constituted by an edge of said hole, and said barb projects into said hole for engaging said seating surface.

6. An artificial representation of a plant according to claim 5; in which said plant organ simulating member having said rod-like connecting portion includes a stem portion from which said rod-like connecting portion extends, and said plant organ simulating member having said tubular connecting portion includes a petiole-like part extending substantially axially from said other end of the tubular connecting portion.

7. An artificial representation of a plant according to claim 1; in which said barb is substantially triangular and undercut at the side thereof facing away from said free end of the rod-like connecting portion.

* * * * *